US009612545B2

(12) United States Patent
Bejat et al.

(10) Patent No.: US 9,612,545 B2
(45) Date of Patent: Apr. 4, 2017

(54) CHEMICALLY PREPARED CORE SHELL TONER FORMULATION INCLUDING A STYRENE ACRYLATE POLYESTER COPOLYMER USED FOR THE SHELL

(71) Applicant: Lexmark International, Inc., Lexington, KY (US)

(72) Inventors: Ligia Aura Bejat, Lexington, KY (US); Claudia Alexandra Marin Goggin, Lexington, KY (US); Cory Nathan Hammond, Winchester, KY (US); Rick Owen Jones, Berthoud, CO (US); Robert Watson McAlpine, Lexington, KY (US); Jing X Sun, Lexington, KY (US); Peter Nikolaivich Yaron, Denver, CO (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 14/795,173

(22) Filed: Jul. 9, 2015

(65) Prior Publication Data

US 2017/0010549 A1 Jan. 12, 2017

(51) Int. Cl.
*G03G 9/093* (2006.01)
*G03G 9/087* (2006.01)

(52) U.S. Cl.
CPC ..... *G03G 9/09342* (2013.01); *G03G 9/08711* (2013.01); *G03G 9/08755* (2013.01); *G03G 9/09321* (2013.01); *G03G 9/09328* (2013.01); *G03G 9/09385* (2013.01)

(58) Field of Classification Search
CPC ..... G03G 9/09342; G03G 9/09328; G03G 9/09385; G03G 9/09321
USPC ..... 430/110.2
See application file for complete search history.

(56) References Cited

U.S. PATENT DOCUMENTS

| | | | | |
|---|---|---|---|---|
| 5,073,469 | A | 12/1991 | Diaz | |
| 6,331,372 | B1 | 12/2001 | Livengood | |
| 6,492,083 | B1 | 12/2002 | Livengood | |
| 6,531,254 | B1 | 3/2003 | Bedells | |
| 6,531,256 | B1 | 3/2003 | Bedells | |
| 6,534,230 | B1 | 3/2003 | Blair | |
| 6,991,884 | B2 | 1/2006 | Sun | |
| 7,435,523 | B2 | 10/2008 | Olson | |
| 7,504,189 | B2 | 3/2009 | Sun | |
| 7,510,812 | B2 | 3/2009 | Earley | |
| 7,695,882 | B2 | 4/2010 | Broce | |
| 7,897,318 | B2 | 3/2011 | Peter | |
| 7,923,191 | B2 | 4/2011 | Bertelsen | |
| 7,939,236 | B2 | 5/2011 | Beach | |
| 8,669,035 | B2 | 3/2014 | Sun | |
| 9,023,569 | B2 | 5/2015 | Sun | |
| 2005/0048394 | A1* | 3/2005 | Iga | G03G 9/08 430/137.17 |
| 2008/0063966 | A1 | 3/2008 | Mattison | |
| 2009/0029282 | A1* | 1/2009 | Bertelsen | G03G 9/0806 430/137.14 |
| 2009/0087765 | A1 | 4/2009 | Kidokoro | |
| 2009/0155705 | A1 | 6/2009 | Jones | |
| 2010/0062359 | A1 | 3/2010 | Bensing | |
| 2011/0003242 | A1 | 1/2011 | Hayashi | |
| 2012/0052430 | A1* | 3/2012 | Yamasaki | G03G 9/09321 430/105 |
| 2013/0171553 | A1* | 7/2013 | Sun | G03G 9/09328 430/108.6 |
| 2015/0370186 | A1* | 12/2015 | Fu | G03G 9/0833 430/106.2 |

* cited by examiner

*Primary Examiner* — Christopher Rodee

(57) ABSTRACT

A chemically prepared toner composition according to one example embodiment includes a core including at least one polymer binder, a colorant and a release agent; a shell that is formed around the core and includes a third polymer binder; and a borax coupling agent between the core and the shell. The binder for the shell is a styrene acrylic polyester copolymer having a glass transition temperature (Tg) between 55° C. to 65° C., a melt temperature (Tm) between 100° C. to 130° C., a peak molecular weight of about 12,000 and acid value from 10-28.

8 Claims, No Drawings

CHEMICALLY PREPARED CORE SHELL TONER FORMULATION INCLUDING A STYRENE ACRYLATE POLYESTER COPOLYMER USED FOR THE SHELL

CROSS REFERENCES TO RELATED APPLICATIONS

None

BACKGROUND

Field of the Disclosure

The present invention relates generally to chemically prepared toner having a core shell structure for use in electrophotography and more particularly to emulsion aggregation chemically prepared toner including a styrene acrylic polyester copolymer used for the shell and process to make the same.

Description of the Related Art

Toners for use in electrophotographic printers include two primary types, mechanically milled toners and chemically prepared toners (CPT). Chemically prepared toners have significant advantages over mechanically milled toners including better print quality, higher toner transfer efficiency and lower torque properties for various components of the electrophotographic printer such as a developer roller, a fuser belt and a charge roller. The particle size distribution of CPTs is typically narrower than the particle size distribution of mechanically milled toners. The size and shape of CPTs are also easier to control than mechanically milled toners.

There are several known types of CPT including suspension polymerization toner (SPT), emulsion aggregation toner (EAT)/latex aggregation toner (LAT), toner made from a dispersion of pre-formed polymer in solvent (DPPT) and "chemically milled" toner. While emulsion aggregation toner requires a more complex process than other CPTs, the resulting toner has a relatively narrower size distribution and improved print resolution.

One important characteristic of any toner is its fuse window. The fuse window is the range of temperatures at which fusing is satisfactorily conducted without incomplete fusion and without transfer of toner to the heating element, which may be a roller, belt or other member contacting the toner during fusing. Thus, below the low end of the fuse window the toner is incompletely melted and above the high end of the fuse window the toner flows onto the fixing member where it mars subsequent sheets being fixed. It is preferred that the low end of the fuse window be as low as possible to reduce the required temperature of the fuser in the electrophotographic printer to therefore improve the printer's safety and to conserve energy.

However in addition to fuse at an energy saving low temperature, the toner must also be able to survive the temperature and humidity extremes associated with storage and shipping—commonly called the ship/storage test. Caking or blocking of the toner during shipping and storage usually results in print flaws. Energy saving low fusing toner is desirable but the low end of the fuse window cannot be so low that the toner melts during the storing or shipping of a cartridge containing the toner. A low melt/low energy fusing toner must be robust to shipping and storage conditions in order to be attractive in a worldwide market. However, many toner formulations cannot simultaneously meet the demand to fuse at low temperatures while also passing the ship/storage tests.

Accordingly, it will be appreciated a core shell toner formulation and process to make the same that can fuse at an energy saving low temperature while passing the ship/storage test is desirable.

SUMMARY

A chemically prepared core shell toner composition according to one example embodiment includes a core including a polymer binder or a mixture of polymer binders, a colorant and a release agent; a shell including a polymer binder that is formed around the core; and a reversible borax coupling agent added to the outer surface of the core during the process of making the toner of the present invention. Specifically, the polymer binder in the shell is a styrene acrylate polyester copolymer having a glass transition temperature (Tg) between 55° C. to 65° C., a melt temperature (Tm) between 100° C. to 130° C., a peak molecular weight of about 12,000 and acid value from 10-28. The polymer binder or mixture of polymer binders in the toner core is selected from the group consisting of an amorphous polyester resin, a crystalline polyester resin, a semi-crystalline polyester resins and a thermoplastic resin or mixtures thereof. The polymer binder in the shell is different from the polymer binder(s) in the core. All of the polymer binders used in the toner formulation have functional groups.

DETAILED DESCRIPTION

The art to practice the present invention. It is to be understood that the disclosure is not limited to the details of construction and the arrangement of components set forth in the following description or illustrated in the drawings. The invention is capable of other embodiments and of being practiced or of being carried out in various ways. For example, other embodiments may incorporate structural, chronological, process, and other changes. Examples merely typify possible variations. Individual components and functions are optional unless explicitly required, and the sequence of operations may vary. Portions and features of some embodiments may be included in or substituted for those of others. The scope of the application encompasses the appended claims and all available equivalents. The following description is, therefore, not to be taken in a limited sense and the scope of the present invention is defined by the appended claims. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Generally the present disclosure relates to an emulsion aggregation chemically prepared core shell toner composition having a core including at least one polymer binder, a colorant and a release agent. A shell including a different polymer binder is formed around the core. The polymer used for the shell is a styrene acrylate polyester copolymer having a glass transition temperature (Tg) between 55° C. to 65° C., a melt temperature (Tm) between 100° C. to 130° C., a peak molecular weight of about 12,000 and acid value from 10-28. A borax reversible coupling agent is added to the outer surface of the core during the process of making the toner of the present invention, helping to couple the shell to the outer surface of the toner core. After the borax coupling agent is added to the outer surface of the core, the styrene acrylate polyester copolymer shell is placed around the outer surface of the core.

The toner may be utilized in an electrophotographic printer such as a printer, copier, multi-function device or an all-in-one device. The toner may be provided in a cartridge that supplies toner to the electrophotographic printer. Example methods of forming toner using conventional emulsion aggregation techniques may be found in U.S. Pat. Nos. 6,531,254, 6,531,256, and 8,669,035, which are assigned to the applicants of the present invention and are incorporated by reference herein in their entirety.

In the present emulsion aggregation process, the toner particles are provided by chemical methods as opposed to physical methods such as pulverization. Generally, the toner includes one or more polymer binders, a release agent, a colorant, a reversible borax coupling agent and one or more optional additives such as a charge control agent (CCA). Emulsions of the chosen polymer binders are formed in water, optionally with organic solvent, with an inorganic base such as sodium hydroxide, potassium hydroxide, ammonium hydroxide, or an organic amine compound. A stabilizing agent having an anionic functional group (A−), e.g., an anionic surfactant or an anionic polymeric dispersant may also be included. It will be appreciated that a cationic (C+) functional group, e.g., a cationic surfactant or a cationic polymeric dispersant, may be substituted as desired.

The colorant, release agent, and the optional charge control agent are dispersed separately in their own aqueous environments or in one aqueous mixture, as desired, in the presence of a stabilizing agent having similar functionality (and ionic charge) as the stabilizing agent employed in the polymer latex(es). The polymer latex(es) forming the toner core, the release agent dispersion, the colorant dispersion and the optional charge control agent dispersion are then mixed and stirred to ensure a homogenous composition. As used herein, the term dispersion refers to a system in which particles are dispersed in a continuous phase of a different composition (or state) and may include an emulsion. Acid is then added to reduce the pH and cause flocculation. Flocculation refers to the process by which destabilized particles conglomerate (due to e.g., the presence of available counterions) into relatively larger aggregates. In this case, flocculation includes the formation of a gel where resin, colorant, release agent and charge control agent form an aggregate mixture, typically from particles 1-2 microns (μm) in size. Unless stated otherwise, reference to particle size herein refers to the largest cross-sectional dimension of the particle. The aggregated toner particles may then be heated to a temperature that is less than or around (e.g., ±5° C.) the glass transition temperature (Tg) of the amorphous polymer latex in the core to induce the growth of clusters of the aggregate particles. Once the aggregate particles reach the desired size of the toner core, the reversible borax coupling agent is added so that it is on the outer surface of the toner core during the process of making the toner. Following the addition of the borax coupling agent, the polymer latex forming the toner shell is added. This polymer latex aggregates around the toner core and the borax on the outer surface of the toner core to form the toner shell. Specifically this polymer latex in the shell is a styrene acrylate polyester copolymer having a glass transition temperature (Tg) between 55° C. to 65° C., a melt temperature (Tm) between 100° C. to 130° C., a peak molecular weight of about 12,000 and an acid value from 10-28. Once the aggregate particles reach the desired toner size, base may be added to increase the pH and reionize the anionic stabilizing agent to prevent further particle growth or one can add additional anionic stabilizing agents. The temperature is then raised above the glass transition temperature of the polymer latex(es) to fuse the particles together within each cluster. This temperature is maintained until the particles reach the desired circularity. The toner particles are then washed and dried.

The toner particles produced may have an average particle size of between about 3 μm and about 20 μm (number average particle size) including all values and increments there between, such as between about 4 μm and about 15 μm or, more particularly, between about 5 μm and about 7 μm. The toner particles produced may have an average degree of circularity between about 0.90 and about 1.00, including all values and increments there between, such as about 0.93 to about 0.98. The average degree of circularity and average particle size may be determined by a Sysmex Flow Particle Image Analyzer (e.g., FPIA-3000) available from Malvern Instruments. It can be appreciated that the boron coupling agent is part of the final toner particles.

The various components for the emulsion aggregation method to prepare the above referenced toner will be described below. It should be noted that the various features of the indicated components may all be adjusted to facilitate the step of aggregation and formation of toner particles of desired size and geometry. It may therefore be appreciated that by controlling the indicated characteristics, one may first form relatively stable dispersions, wherein aggregation may proceed along with relatively easy control of final toner particle size for use in an electrophotographic printer or printer cartridge.

Polymer Binders

The terms resin and polymer are used interchangeably herein as there is no technical difference between the two. The polyester binder(s) may include a semi-crystalline polyester binder, a crystalline polyester binder, an amorphous polyester binder or a styrene acrylate polyester copolymer. The polyester binder(s) may be formed using acid monomers such as terephthalic acid, trimellitic anhydride, dodecenyl succinic anhydride and fumaric acid. Further, the polyester binder(s) may be formed using alcohol monomers such as ethoxylated and propoxylated bisphenol A Example amorphous polyester resins include, but are not limited to, T100, TF-104, NE-1582, NE-701, NE-2141, NE-1569, Binder C, FPESL-2, W-85N, TL-17, TPESL-10, and TPESL-11 commercially available from Kao Corporation, Bunka Sumida-ku, Tokyo, Japan. Various commercially available crystalline polyester resins meeting the above requirements are available from Kao Corporation, Bunka Sumida-ku, Tokyo, Japan and Reichold Chemical Company, Durham, N.C. under the trade names EPC 2-20, EPC 3-20, 6-20, 7-20, CPES B1, EPC 8-20, EPC 9-20, EPC 10-20, CPES B20, CPES B25 and EM192692. Commercially available styrene acrylate polyester copolymer resins containing the monomers mentioned above including but not limited to STPL-1, STPL-8, HB580, HB688 manufactured by Kao Corporation, Bunka Sumida-Ku, Tokyo, Japan.

In other embodiments, the polymer binder(s) include a thermoplastic type polymer such as a styrene and/or substituted styrene polymer, such as a homopolymer (e.g., polystyrene) and/or copolymer (e.g., styrene-butadiene copolymer and/or styrene-acrylic copolymer, a styrene-butyl methacrylate copolymer and/or polymers made from styrene-butyl acrylate and other acrylic monomers such as hydroxy acrylates or hydroxyl methacrylates); polyvinyl acetate, polyalkenes, poly(vinyl chloride), polyurethanes, polyamides, silicones, epoxy resins, or phenolic resins.

All polymer binders used in the toner formulation have functional groups. The amorphous polyester resin to be used in the core of the toner can be linear or slightly crosslinked. Such light crosslinking will significantly improve the hot offset resistance of the toner. Slightly crosslinked is defined as the amount of gel components in the resin. The Tg of the amorphous polyester to be used in the core is between 50° C.-60° C. The Tm of the amorphous polyester to be used in the core is between 90° C.-110° C. The optimum Tm for the optional crystalline polyester resin to be used in the core is about 70° C. to about 100° C. The quantity of the optional crystalline polyester resin to be used in the toner formulation of the present invention is between 3%-20% (wt) of the polyester resin component in the toner composition, most preferably between 4%-8%. The polymer binder to be used in the inventive shell is styrene acrylate polyester copolymer having a glass transition temperature (Tg) between 55° C. to 65° C., a melt temperature (Tm) between 100° C. to 130° C., a peak molecular weight of about 12,000 and acid value from 10-28.

Reversible Borax Coupling Agent

The coupling agent used herein is borax (also known as sodium borate, sodium tetraborate, or disodium tetraborate). As used herein, the term borax coupling agent is defined as enabling the formation of hydrogen bonds between polymer chains which assists in the anchoring or binding of the polymer found in the shell onto the surface of the toner core containing the polymers or mixture of polymers, thereby helping to couple the shell to the outer surface of the toner core. The borax coupling agent bonds the shell to the outer surface of the core by forming hydrogen bonding between its hydroxyl groups and the functional groups present in the polymers utilized in the inventive toner formulation. The inventors have discovered that the addition of this unique coupling agent into the toner formulation helps the shell to adhere to the core, thereby creating a uniform particle size distribution toner and reducing the free shell particle formation. Typically, coupling agents have multivalent bonding ability. Borax differs from commonly used permanent coupling agents, such as multivalent metal ions (e.g., aluminum and zinc), in that its bonding is reversible based on the temperature and pressure. In the electrophotographic process, toner is preferred to have a low fusing temperature to save energy and a low melt viscosity ("soft") to permit high speed printing at low fusing temperatures. However, in order to maintain the stability of the toner during shipping and storage and to prevent filming of the printer components, toner is preferred to be "harder" at temperatures below the fusing temperature. Borax provides cross-linking through hydrogen bonding between its hydroxyl groups and the functional groups of the molecules it is bonded to. The hydrogen bonding is sensitive to temperature and pressure and is not a stable and permanent bond. For example, when the temperature is increased to a certain degree or stress is applied to the polymer, the bond will partially or completely break causing the polymer to "flow" or tear off. The reversibility of the bonds formed by the borax coupling agent is particularly useful in toner because it permits a "soft" toner at the fusing temperature but a "hard" toner at the storage temperature.

The quantity of the borax coupling agent used herein can be varied. The borax coupling agent may be provided at between about 0.1% and about 5.0% by weight of the total polymer binder in the toner including all values and increments there between, such as between about 0.1% and about 1.0% or between about 0.1% and about 0.5%. If too much coupling agent is used, its bonding may not be completely broken at high temperature fusing. On the other hand, if too little coupling agent is used, it may fail to provide the desired bonding and buffering effects.

Colorant

Colorants are compositions that impart color or other visual effects to the toner and may include carbon black, dyes (which may be soluble in a given medium and capable of precipitation), pigments (which may be insoluble in a given medium) or a combination of the two. A colorant dispersion may be prepared by mixing the pigment in water with a dispersant. Alternatively, a self-dispersing colorant may be used thereby permitting omission of the dispersant. The colorant may be present in the dispersion at a level of about 5% to about 20% by weight including all values and increments there between. For example, the colorant may be present in the dispersion at a level of about 10% to about 15% by weight. The dispersion of colorant may contain particles at a size of about 50 nm to about 500 nm including all values and increments there between. Further, the colorant dispersion may have a pigment weight percent divided by dispersant weight percent (P/D ratio) of about 1:1 to about 8:1 including all values and increments there between, such as about 2:1 to about 5:1. The colorant may be present at less than or equal to about 15% by weight of the final toner formulation including all values and increments there between.

Release Agent

The release agent may include any compound that facilitates the release of toner from a component in an electrophotographic printer (e.g., release from a roller surface). For example, the release agent may include polyolefin wax, ester wax, polyester wax, polyethylene wax, metal salts of fatty acids, fatty acid esters, partially saponified fatty acid esters, higher fatty acid esters, higher alcohols, paraffin wax, carnauba wax, amide waxes and polyhydric alcohol esters or mixtures thereof.

The release agent may therefore include a low molecular weight hydrocarbon based polymer (e.g., $Mn \leq 10,000$) having a melting point of less than about 140° C. including all values and increments between about 50° C. and about 140° C. The release agent may be present in the dispersion at an amount of about 5% to about 35% by weight including all values and increments there between. For example, the release agent may be present in the dispersion at an amount of about 10% to about 18% by weight. The dispersion of release agent may also contain particles at a size of about 50 nm to about 1 μm including all values and increments there between. In addition, the release agent dispersion may be further characterized as having a release agent weight percent divided by dispersant weight percent (RA/D ratio) of about 1:1 to about 30:1. For example, the RA/D ratio may be about 3:1 to about 8:1. The release agent may be provided in the range of about 2% to about 20% by weight of the final toner formulation including all values and increments there between.

Surfactant/Dispersant

A surfactant, a polymeric dispersant or a combination thereof may be used. The polymeric dispersant may generally include three components, namely, a hydrophilic component, a hydrophobic component and a protective colloid component. Reference to hydrophobic refers to a relatively non-polar type chemical structure that tends to self-associate in the presence of water. The hydrophobic component of the polymeric dispersant may include electron-rich functional groups or long chain hydrocarbons. Such functional groups are known to exhibit strong interaction and/or adsorption properties with respect to particle surfaces such as the colorant and the polyester binder resin of the polyester resin emulsion. Hydrophilic functionality refers to relatively polar functionality (e.g., an anionic group) which may then tend to associate with water molecules. The protective colloid component includes a water soluble group with no ionic function. The protective colloid component of the polymeric dispersant provides extra stability in addition to the hydrophilic component in an aqueous system. Use of the protective colloid component substantially reduces the amount of the ionic monomer segment or the hydrophilic component in the polymeric dispersant. Further, the protective colloid component stabilizes the polymeric dispersant in lower acidic media. The protective colloid component generally includes polyethylene glycol (PEG) groups. The dispersant employed herein may include the dispersants disclosed in U.S. Pat. No. 6,991,884 and U.S. Pat. No. 5,714,538, which are assigned to the assignee of the present application and are incorporated by reference herein in their entirety.

The surfactant, as used herein, may be a conventional surfactant known in the art for dispersing non self-dispersing colorants and release agents employed for preparing toner formulations for electrophotography. Commercial surfactants such as the AKYPO series of carboxylic acids from AKYPO from Kao Corporation, Bunka Sumida-ku, Tokyo, Japan may be used. For example, alkyl ether carboxylates and alkyl ether sulfates, preferably lauryl ether carboxylates and lauryl ether sulfates, respectively, may be used. One particular suitable anionic surfactant is AKYPO RLM-100 available from Kao Corporation, Bunka Sumida-ku, Tokyo, Japan, which is laureth-11 carboxylic acid thereby providing anionic carboxylate functionality. Other anionic surfactants contemplated herein include alkyl phosphates, alkyl sulfonates and alkyl benzene sulfonates. Sulfonic acid containing polymers or surfactants may also be employed.

Optional Additives

The toner formulation of the present disclosure may also include one or more conventional charge control agents, which may optionally be used for preparing the toner formulation. A charge control agent may be understood as a compound that assists in the production and stability of a tribocharge in the toner. The charge control agent(s) also help in preventing deterioration of charge properties of the toner formulation. The charge control agent(s) may be prepared in the form of a dispersion in a manner similar to that of the colorant and release agent dispersions discussed above.

The toner formulation may include one or more additional additives, such as acids and/or bases, emulsifiers, extra particular additives, UV absorbers, fluorescent additives, pearlescent additives, plasticizers and combinations thereof. These additives may be desired to enhance the properties of an image printed using the present toner formulation. For example, UV absorbers may be included to increase UV light fade resistance by preventing gradual fading of the image upon subsequent exposures to ultraviolet radiations. Suitable examples of the UV absorbers include, but are not limited to, benzophenone, benzotriazole, acetanilide, triazine and derivatives thereof.

Optionally, extra particular additives such as various sized silicas made also be added to the surface of the toner particle to improve its' flow. The toner of the present invention may then be treated with a blend of extra particulate agents, including medium silica sized 40 nm-50 nm, large colloidal silica sized equal to or greater than 70 nm, and optionally, alumina, small silica, and/or titania. Treatment using the extra particulate agents may occur in one or more steps, wherein the given agents may be added in one or more steps during the blending process.

Example Cyan Pigment Dispersion

About 10 g of AKYPO RLM-100 polyoxyethylene(10) lauryl ether carboxylic acid from Kao Corporation, Bunka Sumida-ku, Tokyo, Japan was combined with about 350 g of de-ionized water and the pH was adjusted to ~7-9 using sodium hydroxide. About 10 g of Solsperse 27000 from Lubrizol Advanced Materials, Cleveland, Ohio, USA was added and the dispersant and water mixture was blended with an electrical stirrer followed by the relatively slow addition of 100 g of pigment blue 15:3. Once the pigment was completely wetted and dispersed, the mixture was added to a horizontal media mill to reduce the particle size. The solution was processed in the media mill until the particle size was about 200 nm. The final pigment dispersion was set to contain about 20% to about 25% solids by weight.

Example Wax Emulsion

About 12 g of AKYPO RLM-100 polyoxyethylene(10) lauryl ether carboxylic acid from Kao Corporation, Bunka Sumida-ku, Tokyo, Japan was combined with about 325 g of de-ionized water and the pH was adjusted to ~7-9 using sodium hydroxide. The mixture was then processed through a microfluidizer and heated to about 90° C. About 60 g of paraffin and ester wax from Cytec Corp., Elizabethtown, Ky. was slowly added while the temperature was maintained at about 90° C. for about 15 minutes. The emulsion was then removed from the microfluidizer when the particle size was below about 300 nm. The solution was then stirred at room temperature. The wax emulsion was set to contain about 10% to about 18% solids by weight.

Example Polyester Resin Emulsion A

A polyester resin having a peak molecular weight of about 11,000, a glass transition temperature (Tg) of about 55° C. to about 58° C., a melt temperature (Tm) of about 115° C., and an acid value of about 8 to about 13 was used. The glass transition temperature is measured by differential scanning calorimetry (DSC), wherein, in this case, the onset of the shift in baseline (heat capacity) thereby indicates that the Tg may occur at about 55° C. to about 58° C. at a heating rate of about 5 per minute. The acid value may be due to the presence of one or more free carboxylic acid functionalities (—COOH) in the polyester. Acid value refers to the mass of potassium hydroxide (KOH) in milligrams that is required to neutralize one gram of the polyester. The acid value is therefore a measure of the amount of carboxylic acid groups in the polyester.

150 g of the polyester resin was dissolved in 450 g of methyl ethyl ketone (MEK) in a round bottom flask with stirring. The dissolved resin was then poured into a beaker. The beaker was placed in an ice bath directly under a homogenizer. The homogenizer was turned on at high shear and 7 g of 10% potassium hydroxide (KOH) solution and 500 g of de-ionized water were immediately added to the beaker. The homogenizer was run at high shear for about 2-4 minutes then the homogenized resin solution was placed in a vacuum distillation reactor. The reactor temperature was maintained at about 43° C. and the pressure was maintained between about 22 inHg and about 23 inHg. About 500 mL of additional de-ionized water was added to the reactor and the temperature was gradually increased to about 70° C. to ensure that substantially all of the MEK was distilled out. The heat to the reactor was then turned off and the mixture was stirred until it reached room temperature. Once the reactor reached room temperature, the vacuum was turned off and the resin solution was removed and placed in storage bottles.

The particle size of the low Tg amorphous polyester resin emulsion was between about 190 nm and about 240 nm (volume average) as measured by a NANOTRAC Particle Size Analyzer. The pH of the resin solution was between about 7.5 and about 8.2.

Example Polyester Resin Emulsion B

A polyester resin having a peak molecular weight of about 15K, a glass transition temperature of about 59° C. to about 63° C., a melt temperature of about 119° C., and an acid value of about 20 to about 22 was used to form an emulsion using the procedure outlines above to make Example Polyester Resin Emulsion A.

Example Styrene Acrylate Polyester Copolymer Resin Emulsion 600 g of the styrene acrylate polyester copolymer resin having a peak molecular weight of about 12,000, a glass transition temperature of about 58° C. to about 62° C., a melt temperature of about 100-107° C., and an acid value of about 23 to about 26 was dissolved in 1200 g of methyl ethyl ketone (MEK) in a round bottom flask. The temperature was raised to 60° C. for two hours before it was allowed to cool back to room temperature. The dissolved resin was then poured into a beaker and placed in an ice bath directly under a homogenizer. The homogenizer was turned on at 10,000 rpm and a solution of 58.3 g of 10% potassium hydroxide (KOH) and 1320 g of de-ionized water was immediately added to the MEK/resin mixture. The homogenizer was run for an additional 4 minutes. The resulting resin solution was mixed with 1.2 g 1520-US Antifoam (Dow Corning) and placed in a vacuum distillation reactor. The solution was heated and the reactor temperature was maintained at 70° C. The pressure was adjusted so that a majority of the MEK would be removed in about 1 hr. After 1.5 hr, 500 mL of additional de-ionized water was added to the reactor and the pressure was reduced even further to ensure that substantially all of the MEK was distilled out (approximately 1 hr at this pressure). The final resin emulsion should have less than 500 ppm MEK. The particle size of the resin emulsion was 198 nm (volume average) as measured by a Nanotrac Particle Size Analyzer. The resin emulsion was diluted to 30% solids and the pH was 6.8.

Example Crystalline Polyester Resin Emulsion

A crystalline polyester resin having a melt temperature of about 82° C., and an acid value of about 15 to about 18 was used to form an emulsion.

125 g of the crystalline polyester resin was dissolved in 375 g of tetrahydrofuran (THF) in a round bottom flask with heat and stirring. The dissolved resin was then poured into a beaker. The beaker was placed under a homogenizer. The homogenizer was turned on at high shear and 17 g of 10% potassium hydroxide (KOH) solution and 400 g of de-ionized water were immediately added to the beaker. The homogenizer was run at high shear for about 2-4 minutes then the homogenized resin solution was placed in a vacuum distillation reactor. The reactor temperature was maintained at about 43° C. and the pressure was maintained between about 22 inHg and about 23 inHg. About 500 mL of additional de-ionized water was added to the reactor and the temperature was gradually increased to about 60° C. to ensure that substantially all of the MEK was distilled out. The heat to the reactor was then turned off and the mixture was stirred until it reached room temperature. Once the reactor reached room temperature, the vacuum was turned off and the resin solution was removed and placed in storage bottles.

The particle size of the crystalline polyester resin emulsion was between about 185 nm and about 235 nm (volume average) as measured by a NANOTRAC Particle Size Analyzer. The pH of the resin solution was about 8.6.

Toner Formulation Examples

Example Toner 1

The Example Crystalline Polyester Resin Emulsion, the Example Polyester Resin Emulsion A and the Example Styrene Acrylate Polyester Copolymer Resin Emulsion are used in a ratio of 4:66:30 (wt), with a core to shell ratio of 70:30 (wt.). The Example Crystalline Polyester Emulsion is combined with the Example Polyester Resin Emulsion A to form the core while the Example Styrene Acrylate Polyester Copolymer Resin Emulsion forms the shell. Components were added to a 2.5 liter reactor in the following relative proportions: 3.62 parts (polyester by weight) of the Example Crystalline Polyester Emulsion, 55 parts (polyester by weight) of the Example Polyester Resin Emulsion A, 5.1 parts (pigment by weight) of the Example Cyan Pigment Dispersion, 11.5 parts (release agent by weight) of the Example Wax Emulsion. Deionized water was then added so that the mixture contained about 12% to about 15% solids by weight.

The mixture was heated in the reactor to 25° C. and a circulation loop was started consisting of a high shear mixer and an acid addition pump. The mixture was sent through the loop and the high shear mixer was set at 10,000 rpm. Acid was slowly added to the high shear mixer to evenly disperse the acid in the toner mixture so that there were no pockets of low pH. Acid addition took about 4 minutes with 210 g of 1% sulfuric acid solution. The flow of the loop was then reversed to return the toner mixture to the reactor and the temperature of the reactor was increased to about 40-45° C. Once the particle size reached 4.5 μm to 5.0 μm (number average), 5% (wt.) borax solution (20 g of solution having 1.0 g of borax) was added. After the addition of borax, 25 parts (polyester by weight) of the Example Styrene Acrylate Polyester Copolymer Resin Emulsion was added to form the shell. The mixture was stirred for about 5 minutes and the pH was monitored. Once the particle size reached 5.5 μm (number average), 4% NaOH was added to raise the pH to about 6.7 to stop the particle growth. The reaction temperature was held for one hour. The particle size was monitored during this time period. Once particle growth stopped, the temperature was increased to 93° C. to cause the particles to coalesce. This temperature was maintained until the particles reached their desired circularity (about 0.98). The toner was then washed and dried.

The dried toner had a volume average particle size of 5.72 μm, measured by a COULTER COUNTER Multisizer 3 analyzer and a number average particle size of 5.24 μm. Fines (<2 μm) were present at 0.34% (by number) and the toner possessed a circularity of 0.970, both measured by the SYSMEX FPIA-3000 particle characterization analyzer, manufactured by Malvern Instruments, Ltd., Malvern, Worcestershire UK.

Example Control Toner 1

The Example Crystalline Polyester Resin Emulsion, the Example Polyester Resin Emulsion A and the Example Polyester Resin Emulsion B are used in a ratio of 5:55:40 (wt), with a core to shell ratio of 60:40 (wt.). The Example Crystalline Polyester Emulsion is combined with the Example Polyester Resin Emulsion A to form the core while the Example Polyester Resin Emulsion B forms the shell.

Components were added to a 2.5 liter reactor in the following relative proportions: 4 parts (polyester by weight) of the Example Crystalline Polyester Emulsion, 44 parts (polyester by weight) of the Example Polyester Resin Emulsion A, 5.1 parts (pigment by weight) of the Example Cyan Pigment Dispersion, 14.2 parts (release agent by weight) of the Example Wax Emulsion. Deionized water was then added so that the mixture contained about 12% to about 15% solids by weight.

The mixture was heated in the reactor to 25° C. and a circulation loop was started consisting of a high shear mixer and an acid addition pump. The mixture was sent through the loop and the high shear mixer was set at 10,000 rpm. Acid was slowly added to the high shear mixer to evenly disperse the acid in the toner mixture so that there were no pockets of low pH. Acid addition took about 4 minutes with 210 g of 1% sulfuric acid solution. The flow of the loop was then reversed to return the toner mixture to the reactor and the temperature of the reactor was increased to about 40-45° C. Once the particle size reached 4.05 μm to 5.0 μm (number average), 5% (wt.) borax solution (20 g of solution having 1.0 g of borax) was added. After the addition of borax, 32 parts (polyester by weight) of the Example Polyester Resin Emulsion B was added to form the shell. The mixture was stirred for about 5 minutes and the pH was monitored. Once the particle size reached 5.5 μm (number average), 4% NaOH was added to raise the pH to about 6.89 to stop the particle growth. The reaction temperature was held for one hour. The particle size was monitored during this time period. Once particle growth stopped, the temperature was increased to 82° C. to cause the particles to coalesce. This temperature was maintained until the particles reached their desired circularity (about 0.97). The toner was then washed and dried.

The dried toner had a volume average particle size of 6.26 μm, measured by a COULTER COUNTER Multisizer 3 analyzer and a number average particle size of 5.28 μm. Fines (<2 μm) were present at 0.50% (by number) and the toner possessed a circularity of 0.985, both measured by the SYSMEX FPIA-3000 particle characterization analyzer, manufactured by Malvern Instruments, Ltd., Malvern, Worcestershire UK.

Test Results

A toner's fusing properties include its fuse window. The fuse window is the range of temperatures at which fusing is satisfactorily conducted without incomplete fusion and without transfer of toner to the heating element, which may be a roller, belt or other member contacting the toner during fusing. Thus, below the low end of the fuse window the toner is incompletely melted and above the high end of the fuse window the toner flows onto the fixing member where it mars subsequent sheets being fixed. It is preferred that the low end of the fuse window be as low as possible to reduce the required temperature of the fuser in the electrophotographic printer to improve the printer's safety and to conserve energy. Another toner property that is measured is called the Ship to Store property. Toner must be able to survive the temperature and humidity extremes associated with storage and shipping without caking or blocking which may result in print flaws. As a result, the low end of the fuse window cannot be so low that the toner could melt during the storing or shipping of a toner cartridge containing the toner.

Fusing Window

Each toner composition was used to print 24# Hammermill laser paper (HMLP) using a fusing robot at 60 pages per minute (ppm) with a toner coverage of 1.1 mg/cm$^2$ employing various fusing temperatures as shown in Tables 1 and 2 below. The temperatures indicated in Tables 1 and 2 are the temperatures of the fusing robot's heating element/heater. For each toner composition, various fuse grade measurements were performed. These fuse grade measurements include a scratch resistance test shown in Table 1 and a conventional 60 degree gloss test shown in Table 2. For the scratch resistance test, the printed samples were evaluated using a TABER ABRADER device from TABER Industries, North Tonawanda, N.Y., USA. The printed samples were evaluated on the TABER ABRADER scale from 0 to 10 (where a rating of 10 indicates the most scratch resistance). The TABER ABRADER device scratches the printed samples multiple times with different forces until the toner is scratched off the sample. The point at which the toner is scratched off corresponds with a number rating between 0 and 10 on the TABER ABRADER scale. As is known in the art, the conventional 60 degree gloss test includes shining a known amount of light at the surface of the printed sheet at a 60 degree angle and measuring its reflectance. A higher gloss test value indicates that more energy was transferred to the substrate when it moved through the fuser. The gloss of the print also relates to the resin and release agent used in the toner.

TABLE 1

Scratch Test

| Fusing Temp. (° C.) | Toner 1 | Control Toner 1 |
|---|---|---|
| 155 | CO | |
| 160 | 1.6667 | CO |
| 165 | 10 | 7.3 |
| 170 | 10 | 10 |
| 175 | 10 | 10 |
| 180 | 10 | 10 |
| 185 | 10 | 10 |
| 190 | 10 | 10 |
| 195 | 10 | 10 |
| 200 | 10 | 10 |
| 205 | 10 | 10 |
| 210 | 10 | 10 |
| 215 | 10 | 10 |
| 220 | 10 | 10 |
| 225 | 10 | 10 |
| 230 | 10 | 10 |

TABLE 2

Gloss Test

| Fusing Temperature (° C.) | Toner 1 | Control Toner 1 |
|---|---|---|
| 155 | — | — |
| 160 | 9.6 | — |
| 165 | 10.8 | 13.4 |
| 170 | 12.3 | 13.4 |
| 175 | 13.4 | 15.8 |
| 180 | 15.5 | 16.9 |
| 185 | 17 | 18.9 |
| 190 | 19.3 | 21.8 |
| 195 | 21.8 | 24 |
| 200 | 24 | 24.9 |
| 205 | 23.9 | 25.4 |
| 210 | 25 | 27.6 |
| 215 | 23.2 | 30.3 |
| 220 | 21.1 | 31 |

As shown in Table 1, Toner 1 having the styrene acrylic polyester copolymer used for the shell exhibited better fusing performance compared to the Control Toner 1. The low ends of the fusing window for Toner 1 was lower than the low end of the fusing window for the Control Toner 1. Specifically, Toner 1 provided acceptable scratch resistance at temperatures as low as 160° C. The Control Toner 1 was unable to provide acceptable scratch resistance at this temperature and instead showed cold offset ("CO"), which means the toner failed to fuse to the paper. Accordingly, less energy was required to accomplish an acceptable fusing operation for Toner 1 than the Control Toner 1.

Additionally as shown in Table 2, the gloss for Toner 1 having the styrene acrylic polyester copolymer used for the shell is more uniform compared to the gloss for Control Toner 1.

Accelerated Ship/Store Test

The accelerated ship/store test involves using 8 gm of toner, place in a container, with a 75 gm load placed over it. System is then subjected to the required temperature under evaluation, for 48 hrs. Torque is measured using a probe and value shown corresponds to the resistance offered by the toner sample to the probe, units are in gradient/sec. Typically the lower the value the better. A high $60^{th}$ value is considered failure of the test. Under the current ship/store test conditions, Toner 1 passed the ship/store test—scoring 64/54° C. This is important because Toner 1 had better fusing results than the Control Toner 1 and passed the ship/store test.

Example Toner 2

Example Toner 2 is formulated without any crystalline polyester resin in the core. The Example Polyester Resin Emulsion A and Example Styrene Acrylate Polyester Copolymer Resin Emulsion are used in a core to shell ratio of 65:35 (wt.). The Example Polyester Resin Emulsion A forms the core while the Example Styrene Acrylate Polyester Copolymer Resin Emulsion forms the shell. Components were added to a 2.5 liter reactor in the following relative proportions: 54.2 parts (polyester by weight) of the Example Polyester Resin Emulsion A, 5.1 parts (pigment by weight) of the Example Cyan Pigment Dispersion, 11.5 parts (release agent by weight) of the Example Wax Emulsion. Deionized water was then added so that the mixture contained about 12% to about 15% solids by weight.

The mixture was heated in the reactor to 25° C. and a circulation loop was started consisting of a high shear mixer and an acid addition pump. The mixture was sent through the loop and the high shear mixer was set at 10,000 rpm. Acid was slowly added to the high shear mixer to evenly disperse the acid in the toner mixture so that there were no pockets of low pH. Acid addition took about 4 minutes with 210 g of 1% sulfuric acid solution. The flow of the loop was then reversed to return the toner mixture to the reactor and the temperature of the reactor was increased to about 40° C.-45° C. Once the particle size reached 4.5 μm to 5.0 μm (number average), 5% (wt.) borax solution (20 g of solution having 1.0 g of borax) was added. After the addition of borax, 29.2 parts (polyester by weight) of the Example Styrene Acrylic Polyester Copolymer Resin Emulsion was added to form the shell. The mixture was stirred for about 5 minutes and the pH was monitored. The mixture was heated to 54° C. Once the particle size reached 5.5 μm (number average), 4% NaOH was added to raise the pH to about 6.7 to stop the particle growth. The reaction temperature was held for one hour. The particle size was monitored during this time period. Once particle growth stopped, the temperature was increased to 93° C. to cause the particles to coalesce. This temperature was maintained until the particles reached their desired circularity (about 0.98). The toner was then washed and dried.

The dried toner had a volume average particle size of 5.9 μm, measured by a COULTER COUNTER Multisizer 3 analyzer and a number average particle size of 4.7 μm. Fines (<2 μm) were present at 2.3% (by number) and the toner possessed a circularity of 0.97, both measured by the SYSMEX FPIA-3000 particle characterization analyzer, manufactured by Malvern Instruments, Ltd., Malvern, Worcestershire UK.

Example Control Toner 2

Example Control Toner 2 is a commercially available chemically processed core shell polyester toner formulation manufactured by Xerox, Inc. under the tradename ECO toner.

TABLE 3

Scratch Test

| Fusing Temperature (° C.) | Toner 2 | Control Toner 2 |
|---|---|---|
| 175 | 2.67 | CO |
| 180 | 6.34 | 2.34 |
| 185 | 9.34 | 7.67 |
| 190 | 10 | 10 |
| 195 | 10 | 10 |
| 200 | 10 | 10 |
| 205 | 10 | 10 |
| 210 | 10 | 10 |
| 215 | 10 | 10 |
| 220 | 10 | 10 |
| 225 | 10 | 10 |
| 230 | 10 | 10 |

TABLE 4

Gloss Test

| Fusing Temperature (° C.) | Toner 2 | Control Toner 2 |
|---|---|---|
| 175 | 12.3 | — |
| 180 | 12.4 | 13.4 |
| 185 | 12.5 | 13.5 |
| 190 | 13.8 | 13.7 |
| 195 | 14 | 16.1 |
| 200 | 15.2 | 17.2 |
| 205 | 16.4 | 18.4 |
| 210 | 17.6 | 20.2 |
| 215 | 19.1 | 20.4 |
| 220 | 19.7 | 22.3 |
| 225 | 20.9 | 15.4 |
| 230 | 21.7 | 14.4 |

As shown in Table 3, Toner 2 having the styrene acrylic polyester copolymer used for the shell exhibited comparable fusing performance to the Control Toner 2 having a different polyester resin used as its shell. The low ends of the fusing window for Toner 2 was lower than the low end of the fusing window for the Control Toner 2. Specifically, Toner 2 provided acceptable scratch resistance at temperatures as low as 175° C. The Control Toner 2 was unable to provide acceptable scratch resistance at this temperature and instead showed cold offset ("CO"), which means the toner failed to fuse to the paper. Accordingly, less energy was required to accomplish an acceptable fusing operation for Toner 2 than the Control Toner 2.

Additionally as shown in Table 4, the gloss for Toner 2 having the styrene acrylic polyester copolymer used for the shell is more uniform compared to the gloss for Control Toner 2.

Accelerated Ship/Store Test

The accelerated ship/store test involves using 8 gm of toner, place in a container, with a 75 gm load placed over it. System is then subjected to the required temperature under evaluation, for 48 hrs. Torque is measured using a probe and value shown corresponds to the resistance offered by the toner sample to the probe, units are in gradient/sec. Typically the lower the value the better. A high $60^{th}$ value is considered failure of the test. Under the current ship/store test conditions, Toner 1 passed the ship/store test—scoring 59/52° C. This is important because Toner 2 had better fusing results than the Control Toner 2 and also passed the ship/store test.

The foregoing description of several embodiments has been presented for purposes of illustration. It is not intended to be exhaustive or to limit the application to the precise forms disclosed, and obviously many modifications and variations are possible in light of the above teaching. It is understood that the invention may be practiced in ways other than as specifically set forth herein without departing from the scope of the invention. It is intended that the scope of the application be defined by the claims appended hereto.

What is claimed is:

1. A chemically prepared toner composition, comprising:

a core having an outer surface, the core having components including a first polymer binder having functional groups, a colorant and a release agent;

a borax coupling agent located on the outer surface of the core; and a shell formed around the outer surface of the core and the borax coupling agent, the shell including a styrene acrylate polyester copolymer binder having functional groups, wherein styrene acrylate polyester copolymer binder having functional groups in the shell has a peak molecular weight of about 12,000, and wherein the borax coupling agent is located between the core and the shell and bonds the shell to the outer surface of the core by forming hydrogen bonding between its hydroxyl groups and the functional groups present in the first binder and the styrene acrylate polyester copolymer binder.

2. The chemically prepared toner composition of claim 1, wherein the polymer binder having functional groups in the core is a polyester resin or a mixture of different polyester resins.

3. The chemically prepared toner composition of claim 1, wherein the polymer binder having functional groups in the core is a styrene acrylate resin or a mixture of different styrene acrylate resins.

4. The chemically prepared toner composition of claim 1, wherein the polymer binder having functional groups in the core is a mixture including a styrene acrylate resin and a polyester resin or a mixture of multiple polyester and styrene acrylic resins.

5. The chemically prepared toner composition of claim 1, wherein styrene acrylate polyester copolymer binder having functional groups in the shell has a glass transition temperature (Tg) between 55° C. to 65° C.

6. The chemically prepared toner composition of claim 1, wherein styrene acrylate polyester copolymer binder having functional groups in the shell has a melt temperature (Tm) between 100° C. to 130° C.

7. The chemically prepared toner composition of claim 1, wherein styrene acrylate polyester copolymer binder having functional groups in the shell has an acid value from 10-28.

8. A chemically prepared toner composition, comprising:

a core having an outer surface, the core having components including a first polymer binder having functional groups, a colorant and a release agent;

a borax coupling agent located on the outer surface of the core; and a shell formed around the outer surface of the core and the borax coupling agent, the shell including a styrene acrylate polyester copolymer binder having functional groups and a glass transition temperature (Tg) between 55° C. to 65° C., a melt temperature (Tm) between 100° C. to 130° C., a peak molecular weight of about 12,000 and acid value from 10-28 wherein the borax coupling agent is located between the core and the shell and bonds the shell to the outer surface of the core by forming hydrogen bonding between its hydroxyl groups and the functional groups present in the first binder and the styrene acrylate polyester copolymer binder.

* * * * *